US006378656B1

(12) United States Patent
Kohler

(10) Patent No.: US 6,378,656 B1
(45) Date of Patent: Apr. 30, 2002

(54) LADDER LEVELER

(76) Inventor: Thomas Paul Kohler, 69 Oswego St., Baldwinsville, NY (US) 13027

( * ) Notice: Subject to any disclaimer, the term of this patent is extended or adjusted under 35 U.S.C. 154(b) by 0 days.

(21) Appl. No.: 09/664,244

(22) Filed: Sep. 18, 2000

Related U.S. Application Data

(60) Provisional application No. 60/164,392, filed on Nov. 9, 1999.

(51) Int. Cl.[7] ..... E06C 7/00
(52) U.S. Cl. ..... 182/300; 182/129
(58) Field of Search ..... 182/200, 201, 182/129; 248/188.3

(56) References Cited

U.S. PATENT DOCUMENTS 2,245,713 A * 6/1941 Redmond ..... 248/188.3
3,278,147 A * 10/1966 Olander ..... 248/188.3
4,993,514 A * 2/1991 Ferguson ..... 182/200

FOREIGN PATENT DOCUMENTS

AT 234308 * 6/1964 ..... 248/188.3
FR 1520525 * 4/1968 ..... 182/200

* cited by examiner

*Primary Examiner*—Alvin Chin-Shue

(57) ABSTRACT

A ladder leveler is disclosed in which two pivoting arms are mounted on a base plate to provide a self-adjusting and infinitely adjustable device. The two arms cooperate with a movable locking member or tumbler which is mounted between the arms and shaped to permit the arms to self adjust for uneven ground and lock the arms against movement when weight is placed on the ladder. The device may be readily secured to and removed from the base of a ladder without extensive disassembly.

3 Claims, 1 Drawing Sheet

LADDER LEVELER

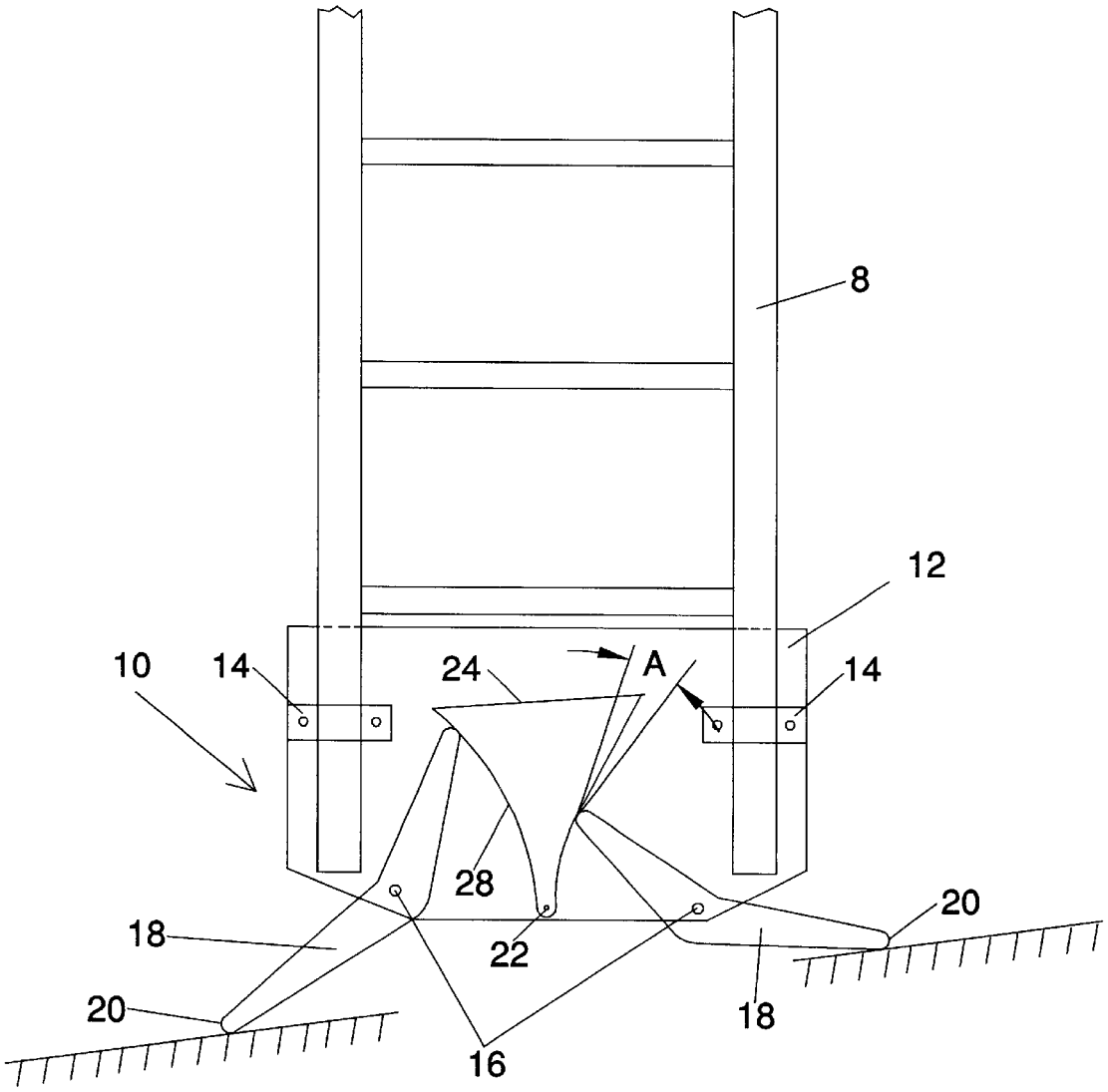
FIG 1 LADDER LEVELER

LADDER LEVELER

CROSS-REFERENCE TO RELATED APPLICATIONS

This application claim benefit to provisional No. 60/164,392 filed Nov. 9, 1999.

STATEMENT REGARDING FEDERALLY SPONSORED RESEARCH AND DEVELOPMENT

There was no Federal sponsorship or funding

REFERENCE TO MICROFICHE APPENDIX

Not Applicable

BACKGROUND OF THE INVENTION

The present invention relates to ladders and more particularly devices for leveling ladders on uneven surfaces and more specifically devices for automatically leveling ladders.

Setting a ladder firmly on uneven ground is commonly achieved by using wood blocks and shims. Many patents have been granted for devices which attach to the ladder and provide some adjustment to accommodate the uneven ground. Commercial success of these devices has been limited, all of them being handicapped by some inconvenience in attachment to the ladder or in operation.

For example, U.S. Pat. No. 5,273,133 by Thocher, et.al. while purporting to provide automatic adjustment, does not provide infinite resolution in the compensation for height variation, is not easily attached and removed from the ladder, does not improve the lateral stability of the ladder and is not a simple design which would permit relatively inexpensive manufacture. Infinite resolution of the set up is achieved by the screw jack of U.S. Pat. No. 4,744,441 by Sandstrom but it is not automatic, requiring the operator to turn the screw in or out to accommodate terrain differences. U.S. Pat. No. 5,609,222 by Horbacewicz discloses a device which may attach easily to a ladder, however the set up is not automatic and resolution is course because the extension of the leg attachment is determined by a pin in one of a row of holes. Additionally, prior art ladder levelers generally do not provide for an increase in the stability of the ladder beyond that of the bare ladder. Thus, there remains a need in the art for a ladder leveler which addresses the deficiencies of the prior art devices.

SUMMARY OF THE INVENTION

It is therefore an objective of the present invention to provide a ladder leveler that will automatically set up and lock to compensate for terrain height variations at each leg.

It is a further objective of the invention to provide relatively fine resolution in the compensation for height variation,.

A further objective of the invention is to provide a device which may be easily attached or removed from the ladder.

Another objective is to improve the lateral stability of the ladder by providing a wider stance for the ladder.

These and other objectives are met by the present invention, which includes a base member adapted to be secured to the ladder and first and second arms pivotably mounted on the base member. The arms have lock ends and opposite support ends. A locking member is also pivotably mounted on the base member between the arms such that the lock end of each arm bears against the locking member. The arms and locking member are arranged such that a force applied to one arm as a result of resting the device on the ground causes the locking member to bear against the opposite arm thereby conforming the arms to the uneven ground profile and supporting the ladder. In one embodiment, the locking member has concave bearing surfaces against which the lock ends of the arms bear.

Preferably, the locking member is shaped such that an angle between a tangent at the contact point between the lock end of an arm and the locking member and a tangent to an arc described by the motion of the arm lock end is between about 12 and 20 degrees.

BRIEF DESCRIPTION OF THE DRAWING.

These and other features and advantages of the invention will be further appreciated by reference to the drawing in which FIG. 1 is an elevation view of one embodiment of the present invention, wherein an optional cover is removed.

DETAILED DESCRIPTION OF THE PREFERRED EMBODIMENTS

Referring to FIG. 1, an embodiment of ladder leveler 10 according to the present invention includes mounting plate 12 serving as a base member which may be clamped to the base of ladder 8, for example by U-bolt clamps 14 or other suitable means. Mounting plate 12 supports pivots 16 of two movable arms 18, which bear on the terrain T at their outboard ends 20. Mounting plate 12 also supports pivot 22 for tumbler 24. In order to provide a wider support for the ladder, arms 18 may have a slightly curved or boomerang shape as shown in FIG. 1. In a preferred embodiment of the invention a second plate is provided, which serves as a cover to prevent contamination of the pivots and the surface of the tumbler, supports the second end of the pivot pins, and restricts the motion of the moving parts to a single plane. The device is shown with the second plate removed, to make the action and shape of the movable parts more apparent.

Tumbler 24 is situated so that when moved by bearing on a first of arms 18, the tumbler takes a position that restricts the motion of the second arm, thereby preventing further motion of either arm thereby locking the arms in place and thus enabling each arm to bear a proper porting of the weight of the ladder and user regardless of the pitch of the terrain. Tumbler 24 preferably has concavely curved bearing surfaces 28, against which arms 18 bear. The shape of tumbler 24 is a factor in determining the stiffness of the lock position. Preferably, tumbler 24 would be shaped such than an angle, as measured at any contact point between an arm and the tumbler, between the tangent at the contact point and the tangent to the arc described by the motion of the arm (shown as angle A) is between about 12 to 20 degrees and more preferably approximately 13.5 to 16.5 degrees. In a preferred embodiment, angle A will be approximately 15 degrees. More acute angles will provide a stiffer lock, but may not easily adjust to a different ground contour when repositioning the ladder. As will be appreciated by persons skilled in the art based on the teachings herein, an optimum angle A for a particular embodiment will depend on the coefficient of friction at the contact point of the tumbler with the movable arm and should be chosen so that lock is maintained so long as the arm bearing the least part of the total load still bears on the ground. Suitable materials will include, but are not limited to wood, plastics and metal.

In use, tumbler 24 and movable arms 18 rotate about pivot points 16 until the upward force from bearing on the ground forces them together, preventing further motion, thus enabling the ladder to bear balanced or unbalanced loads without tipping. As shown in FIG. 1, tumbler 24 and movable arms 18 are positioned as they would be if the ground beneath the left rail of the ladder is lower than the ground beneath the right rail. A Ladder with the leveler attached according to the present invention has an effective stance wider than the bare ladder, and the ladder/leveler system will be stable even if the operator, by reaching off to the side, places his center of gravity outside the rails of the ladder.

The forgoing describes merely an example of a preferred embodiment of the present invention and is not intended to limit the scope of the invention. Modifications and variations to the preferred embodiments described will be apparent to those of skill in the art based on the forgoing detailed description. For example, the tumbler could be constrained to move horizontally by a slot or rail, rather than by rotation about a pivot. Such modifications and variations are within the scope of the invention as defined by the following claims.

What I claim as my invention is:

1. A device for leveling ladders on uneven ground, comprising:

a base member adapted to be secured to the ladder;

first and second arms pivotably mounted on said base member, said arms having lock ends and opposite support ends; and a locking member mounted to the base member with one degree of freedom, between said arms, such that the lock end of each of said arms bear against the locking member;

said arms and locking member being arranged such that a force applied to one arm as a result of resting the device on the ground causes the locking member to bear against the opposite arm thereby restricting further motion of said arms and locking member in a position conforming said arms to the uneven ground profile.

2. The device according to claim 1, wherein the locking member has concave bearing surfaces against which the lock ends of said arms bear.

3. The device according to claim 1 wherein the locking member is shaped such that the angle between a tangent at the contact point between said lock end and said locking member and a tangent to an arc described by the motion of the arm lock end is approximately 15 degrees.

* * * * *